US005439502A

United States Patent [19]

Kodas et al.

[11] Patent Number: 5,439,502

[45] Date of Patent: Aug. 8, 1995

[54] METHOD FOR MAKING SILVER POWDER BY AEROSOL DECOMPOSITION

[75] Inventors: Toivo T. Kodas; Timothy L. Ward, both of Albuquerque, N. Mex.; Howard D. Glicksman, Wilmington, Del.

[73] Assignees: E. I. Du Pont de Nemours and Company, Wilmington, Del.; University of New Mexico, Albuquerque, N. Mex.

[21] Appl. No.: 225,413

[22] Filed: Apr. 8, 1994

Related U.S. Application Data

[63] Continuation of Ser. No. 956,271, Oct. 5, 1992, abandoned.

[51] Int. Cl.[6] ..... B22F 9/24

[52] U.S. Cl. ..... 75/365; 75/368; 75/369; 75/741

[58] Field of Search ..... 75/365, 368–371, 75/741

[56] References Cited

U.S. PATENT DOCUMENTS

| | | | |
|---|---|---|---|
| 4,023,961 | 5/1977 | Douglas et al. | 75/355 |
| 4,396,420 | 8/1983 | Schmidberger et al. | 75/0.5 AC |
| 4,994,107 | 2/1991 | Flagan et al. | 75/367 |

FOREIGN PATENT DOCUMENTS 62-1807 1/1987 Japan .
62-2404 1/1987 Japan .

OTHER PUBLICATIONS

Chemical Abstracts, vol. 113, No. 26, Dec. 24, 1990, L. S. Radkevich et al., "Preparation of silver powder from organometallic compound", p. 274, col. 2.

Chemical Abstracts, vol. 108, No. 24, Jun. 13, 1988, S. M. Ryabykh et al., "Formation and properties of ultrafine metal particles during decomposition of heavy metal azides", p. 257, col. 2.

Chemical Abstracts, vol. 71, No. 4, Jul. 28, 1969, A. G. Sutugin et al., "Preparation of finely divided powders via the aerosol state", p. 110, col. 1.

Nagashima, et al., "Preparation of Fine Metal Particles from Aqueous Solutions of Metal Nitrate by Chemical Flame Method", Nippon Kagaku Kaishi, No. 12, pp. 2293–2300, 1987.

Kato, et al., "Preparation of Silver Particles by Spray Pyrolysis Technique", Nippon Kagaku Zasshi, No. 12, pp. 2342–2344, 1985.

*Primary Examiner*—George Wyszomierski

[57] ABSTRACT

A method for the manufacture of finely divided silver particles comprising the sequential steps:

A. Forming an unsaturated solution of thermally decomposable silver-containing compound in a volatilizable solvent;

B. Forming an aerosol from the unsaturated solution and a carrier gas;

C. Heating the aerosol to a temperature above the decomposition temperature of the silver compound, but below the melting point of silver metal by which the silver compound is decomposed to form finely divided particles of pure densified silver; and D. Separating the precipitated silver particles from the carrier gas, reaction by-products and solvent voltilization products.

5 Claims, 2 Drawing Sheets

METHOD FOR MAKING SILVER POWDER BY AEROSOL DECOMPOSITION

This is a continuation of application Ser. No. 07/956,271 filed Oct. 5, 1992, now abandoned.

FIELD OF INVENTION

The invention is directed to an improved process for making silver powders. In particular, the invention is directed to a process for making such powders that are fully dense with high purity and with spherical morphology.

BACKGROUND OF THE INVENTION

Silver powder is used in the electronics industry for the manufacture of conductor thick film pastes. The thick film pastes are screen printed onto substrates forming conductive circuit patterns. These circuits are then dried and fired to volatilize the liquid organic vehicle and sinter the silver particles.

Printed circuit technology is requiring denser and more precise electronic circuits. To meet these requirements, the conductive lines have become more narrow in width with smaller distances between lines. The silver powders necessary to form dense, closely packed, narrow lines must be as close as possible to monosized, smooth spheres.

Many methods currently used to manufacture metal powders can be applied to the production of silver powders. For example, chemical reduction methods, physical processes such as atomization or milling, thermal decomposition and electrochemical processes can be used.

Silver powders used in electronic applications are generally manufactured using chemical precipitation processes. Silver powder is produced by chemical reduction in which an aqueous solution of a soluble salt of silver is reacted with an appropriate reducing agent under conditions such that silver powder can be precipitated. The most common silver salt used is silver nitrate. Inorganic reducing agents including hydrazine, sulfite salts and formate salts can produce powders which are very coarse in size, are irregularly shaped and have a large particle size distribution due to aggregation.

Organic reducing agents such as alcohols, sugars or aldehydes are used with alkali hydroxides to reduce silver nitrate. The reduction reaction is very fast and hard to control and produces a powder contaminated with residual alkali ions. Although small in size ($<1$ micron), these powders tend to have an irregular shape with a wide distribution of particle sizes that do not pack well.

The atomization method for making silver particles is an aerosol decomposition process which involves the conversion of a precursor solution to a powder. The process involves the generation of droplets, transport of the droplets with a gas into a heated reactor, the removal of the solvent by evaporation, the decomposition of the salt to form a porous solid particle, and then the densification of the particle to give fully dense spherical pure particles. Conditions are such that there is no interaction of droplet-to-droplet or particle-to-particle and there is no chemical interaction of the droplets or particles with the carrier gas.

The major problem that has heretofore limited successful application of this technique for powder generation is lack of control over particle morphology. In particular, it is the requirement that the material has to be treated above its melting point to form fully dense particles. Material treated below the melting point has tended to give impure, hollow-type particles which are not densified.

SUMMARY OF THE INVENTION

The invention is directed to a method for the manufacture of finely divided silver particles comprising the sequential steps:

A. Forming an unsaturated solution of thermally decomposable silver-containing compound in a thermally volatilizable solvent;

B. Forming an aerosol consisting essentially of finely divided droplets of the solution from step A dispersed in an inert carrier gas, the droplet concentration which is below the concentration at which coagulation results in a 10% reduction in droplet concentration;

C. Heating the aerosol to an operating temperature above the decomposition temperature of the silver compound, but below the melting point of silver by which (1) the solvent is volatilized, (2) the silver compound is decomposed to form finely divided particles of pure silver, and (3) the silver particles are densified; and D. Separating the silver particles from the carrier gas, reaction by-products and solvent volatilization products.

Definitions

As used herein with respect to the solvent for the silver-containing compound, the term "volatilizable" means that the solvent is completely converted to vapor or gas by the time the highest operating temperature is reached, whether by vaporization and/or by decomposition.

As used herein with respect to silver-containing compounds, the term "thermally decomposable" means that the compound becomes fully decomposed to silver metal and volatilization by-products by the time the highest operating temperature is reached. For example, $AgNO_3$ is decomposed to form Ag metal and NOx gas and organometallic silver compounds are decomposed to form Ag metal, $CO_2$ gas and $H_2O$ vapor.

Prior Art

Kokai 62-2404 (JPA 60-139904), Asada et al.

The reference is directed to thick film pastes prepared from metal powders obtained by misting solutions of the metal salts and heating the mist at a temperature above the decomposition temperature of the metal salt. The reference discloses the use of the misting process for making "alloys". It is also disclosed that the mist must be heated at least 100 C. higher than the melting point of the desired metal or alloy.

Kokoku 63-31522 (Kokai 62-1807) (JPA 60-139903, Asada et al.)

Production of metal powder by atomizing a solution containing metal salts(s) to produce liquid drops, heating the liquid drops to higher than the decomposition temperature of the salt, higher than the metal melting point and higher than the metal oxide decomposition temperature when the metal forms oxide at a temperature below the metal melting point to fuse decomposed metal grains.

U.S. Pat. No. 4,396,420

Spraying of mixed aqueous solution of silver and metal salts in a hot reactor at a wall temperature substantially above the temperature of disintegration of the salts but below the melting points of the individual compounds.

Nagashima et al, Preparation of Fine Metal Particles from Aqueous Solutions of Metal Nitrate by Chemical Flame Method, *Nippon Kagaku Kaishi,* 12, 2293–2300

Fine metal particles were prepared by chemical flame method. When the flame temperature was lower than the melting point, the metal particles were non-spherical, when the flame temperature was sufficiently above the melting point of the metal, particles were formed via the melt and become perfectly spherical.

Kato et al, Preparation of Silver Particles by Spray Pyrolysis Technique, *Nippon Kagaku Zasshi,* No. 12:2342–4(1985)

The reference describes a study of the production of spherical, non-aggregated silver microparticles by spray pyrolysis. It is disclosed that particle surfaces were smooth at temperatures higher than the melting point of Ag (961 C.) and that particle diameter distribution increased as concentration of the reactants was increased. On the other hand, density of the particles dropped as the reaction temperature decreased below the melting point of Ag.

DETAILED DESCRIPTION OF THE INVENTION

Figure 1:
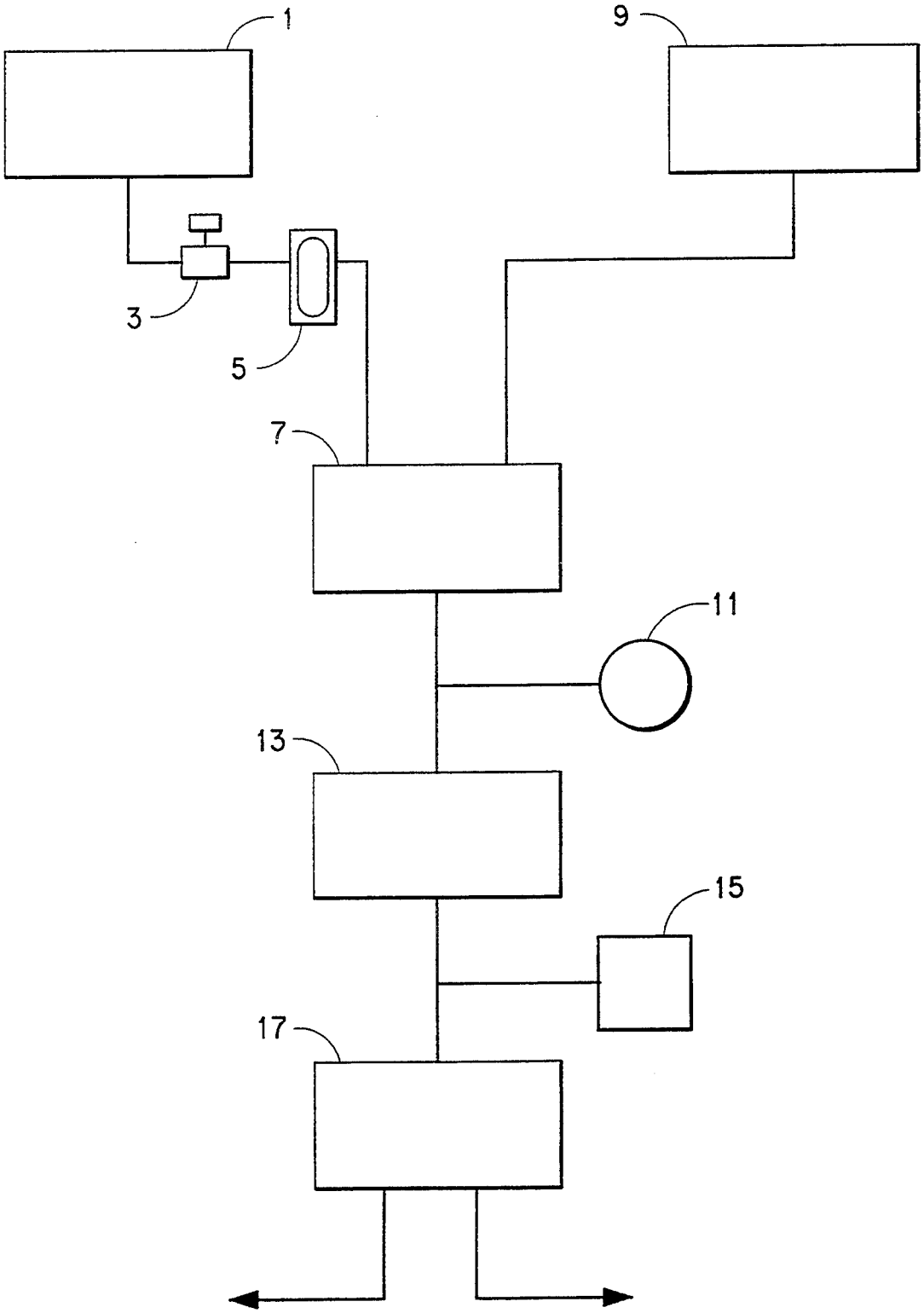
FIG. 1 is a schematic representation of the test apparatus with which the invention was demonstrated and FIG. 2 is an X-ray diffraction pattern of the silver particles produced by the method of the invention.

Silver Compound: Any soluble silver salt can be used in the method of the invention so long as it is inert with respect to the carrier gas used to form the aerosols. Examples of suitable salts are $AgNO_3$, $AgaPO_4$, $Ag_2SO_4$ and the like. Insoluble silver salts such as AgCl are not, however, suitable. The silver salt may be used in concentrations as low as 0.2 mole/liter and upward to just below the solubility limit of the salt. It is preferred not to use concentrations below 0.2 mole/liter or higher than 90% of saturation.

While it is preferred to use water-soluble silver salts as the source of silver for the method of the invention, the method can nevertheless be carried out effectively with the use of other solvent-soluble silver compounds such as organometallic silver compounds dissolved in either aqueous or organic solvents.

Operating Variables: The method of the invention can be carried out under a wide variety of operating conditions so long as the following fundamental criteria are met:

1. The concentration of silver compound in the aerosol must be below the saturation concentration at the feed temperature and preferably at least 10% below the saturation concentration in order to prevent precipitation of solids before removal of the liquid solvent;
2. The concentration of droplets in the aerosol must be sufficiently low that any coalescence of droplets which takes place in the reactor will not give more than a 10% reduction in droplet concentration;
3. The temperature of the reactor must be below the melting point of metallic silver (960 C.).

Though it is essential to operate under the saturation point of the silver-containing compound, its concentration is not otherwise critical in the operation of the process. Much lower concentrations of silver compounds can be used. However, it will ordinarily be preferred to use higher concentrations to maximize the amount of particles that can be made per unit of time.

Any of the conventional apparatus for droplet generation may be used to prepare the aerosols for the invention such as nebulizers, collison nebulizers, ultrasonic nebulizers, vibrating orifice aerosol generators, centrifugal atomizers, two-fluid atomizers, electrospray atomizers and the like. Particle size of the powder is a direct function of the droplet sizes generated. The size of the droplets in the aerosol is not critical in the practice of the method of the invention. However, as mentioned above, it is important that the number of droplets not be so great as to incur excessive coalescence which broadens the particle size distribution.

In addition, for a given aerosol generator, concentration of the solution of silver compound has an effect on particle size. In particular, particle size is an approximate function of the cube root of the concentration. Therefore, the higher the silver compound concentration, the larger the particle size of the precipitated silver. If a greater change in particle size is needed, a different aerosol generator must be used.

Virtually any vaporous material which is inert with respect to the solvent for the silver compound and with respect to the silver compound itself may be used as the carrier gas for the practice of the invention. Examples of suitable vaporous materials are air, nitrogen, oxygen, steam, argon, helium, carbon dioxide and the like. Of these, air and nitrogen are preferred.

The temperature range over which the method of the invention can be carried out is quite wide and ranges from the decomposition temperature of the silver compound up to, but below, the melting point of silver (960 C.). When air is used as the carrier gas, it is preferred to operate at a temperature of at least 900 C. in order to reduce the impurity level in the precipitated silver particles. However, when nitrogen is used as the carrier gas, it is possible to operate at a temperature as low as 600 C. and still get a low impurity level in the silver and full densification of the particles.

The type of apparatus used to heat the aerosol is not by itself critical and either direct or indirect heating may be used. For example, tube furnaces may be used. It is an advantage of the method of the invention that the rate of heating the aerosol (and consequently the residence time as well) is not important from the standpoint of either the kinetics of the reaction or the morphology of the metal powders.

Upon reaching the reaction temperature and the particles are fully densified, they are separated from the carrier gas, reaction by-products and solvent volatilization products and collected by one or more devices such as filters, cyclones, electrostatic separators, bag filters, filter discs and the like. The gas upon completion of the reaction consists of the carrier gas, decomposition products of the silver compound and solvent vapor. Thus, in the case of preparing silver from aqueous silver nitrate using $N_2$ as the carrier gas, the effluent gas from the method of the invention will consist of nitrogen oxide(s), water and $N_2$.

Test Apparatus: The experimental apparatus used in this work is shown schematically in FIG. 1. A source of carrier gas 1 supplies either $N_2$ or air through regulator 3 and flowmeter 5 to aerosol generator 7. Solution reservoir 9 supplies reaction solution to the aerosol generator 7 in which the carrier gas and reaction solution are intimately mixed to form an aerosol comprising droplets of the reaction solution dispersed in the carrier gas. The aerosol produced in generator 7 is passed to reactor 13, a Lindberg furnace having a mullite tube in which the aerosol is heated. The pressure is monitored by gauge 11 between generator 7 and reactor 13. The temperature of the heated aerosol is measured by thermocouple 15 and is passed to heated filter 17. The carrier gas and volatilization products from the decomposition reaction in the furnace are then discharged from the downstream side of the filter 17.

In carrying out the test operations described below, a pressurized carrier gas was directed through the aerosol generator, which then forced the aerosol through a heated reactor. The aerosol droplets were dried, reacted and densified in the furnace and the resulting finely divided metal particles were collected on a filter. A thermocouple at the filter indicated its temperature, which was maintained at about 60 C., to prevent water condensation at the filter. A pressure gauge was maintained upstream of the reactor to indicate any sudden rise in the pressure due to clogging of the filter. The carrier gas was initially air, but ultra-high purity (UHP) nitrogen was also used to reduce the reaction temperature for the formation of pure silver. Two types of aerosol generators were used to determine the effect of droplet size on the metal particle properties: (1) a modified BGI Collison CN-25 generator and (2) a modified ultrasonic Pollenex home humidifier. The reactor temperature was varied between 500 C. and 900 C. The residence times differed as a function of flow rate and reactor temperature and therefore ranged between 5 and 21 seconds. The filter was a nylon membrane filter. The concentration of aqueous $AgNO_3$ solution in the solution reservoir was varied from 0.5 to 4.0 moles/L.

Ten process runs were performed in which the method of the invention was demonstrated. The operating conditions of these runs are shown in Table 1 below, along with selected properties of the silver particles produced therefrom.

TABLE 1

Test Data

| Example No. | 1 | 2 | 3 | 4 | 5 |
|---|---|---|---|---|---|
| Furnace Temperature (C.) | 700 | 800 | 900 | 500 | 600 |
| Carrier Gas | Air | Air | Air | $N_2$ | $N_2$ |
| Type of Aerosol Generator | Ultra[3] | Ultra | Ultra | Ultra | Ultra |
| Silver Concentration (moles/L) | 2.0 | 2.0 | 2.0 | 4.0 | 4.0 |
| Flow Rate (L/min) | 6.22 | 6.22 | 6.22 | 6.65 | 6.65 |
| Residence Time (sec) | 16 | 15 | 14 | 21 | 19 |
| Avg. Particle Size (μm)[5] | — | — | — | — | — |
| Surface Area ($m^2$/g) | — | — | 0.76 | — | 1.40 |
| Weight Loss at 300° C. (%) | 2.6 | 0.8 | None | 0.7 | None[1] |
| **Example No.** | **6** | **7** | **8** | **9** | **10** |
| Furnace Temperature (C.) | 800 | 900 | 900 | 900 | 900 |
| Carrier Gas | $N_2$ | Air | Air | Air | Air |
| Type of Aerosol Generator | Ultra | Collison[4] | Ultra | Ultra | Ultra |
| Silver Concentration (moles/L) | 4.0 | 2.0 | 0.5 | 2.0 | 4.0 |
| Flow Rate (L/min) | 6.65 | 8.4 | 6.22 | 6.22 | 3.90 |
| Residence Time (sec) | 14 | 5 | 14 | 14 | 25 |
| Avg. Particle Size (μm)[5] | — | — | 0.9 | 1.55 | 1.65 |
| Surface Area ($m^2$/g) | 1.40 | 1.23 | — | — | — |
| Weight Loss at 300° C. (%) | None[2] | None | None | None | None |

[1]Density by He pycnometry 10.56 g/cc (theoretical 10.5 g/cc)
[2]Density by He pycnometry 10.49 g/cc
[3]Modified ultrasonic Pollenex home humidifier.
[4]Modified BGI Collison CN-25 generator, BGI Corp., Waltham, MA
[5]D50 by Sedigraph.

Comparison of Examples 1–6 showed quite unexpectedly that the formation of fully densified silver particles can be obtained at a much lower operating temperature when the carrier gas is $N_2$. In particular, the silver particles produced at 600 C. using $N_2$ were fully densified as indicated by zero weight loss. On the other hand, it was necessary to operate at 900 C. in order to obtain silver particles having zero weight loss when air was used as the carrier gas. Thus, the energy requirements for the method are much less when $N_2$ is used as the carrier gas instead of air. It should be noted that in both cases fully densified silver particles were produced well below the melting point of silver (960 C).

A comparison of Examples 3 and 7 shows that the aerosol generator itself influences the size of particles produced at the same operating conditions. In particular, the particle sizes of the silver made using the Collison apparatus were much larger than that of the Pollenex ultrasonic apparatus. This was verified by the comparison of surface areas and Scanning Electron Micrographs.

Comparison of Examples 8–10 shows that increasing the concentration increased the average particle size of the silver powder. That is, particle size is a direct function of silver salt concentration.

Figure 2:
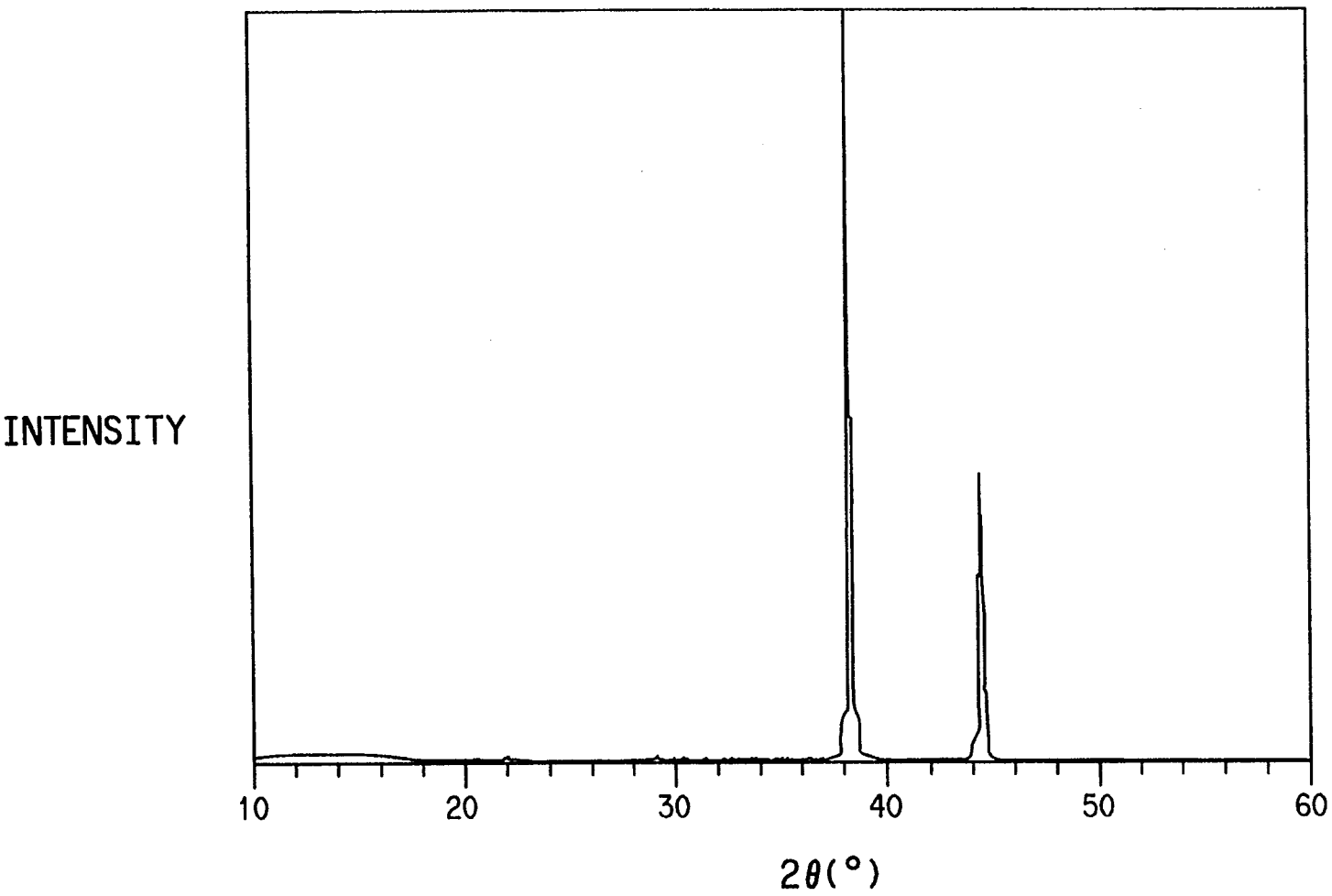

X-ray diffraction and transmission electron microscopy (TEM) examination of the silver particles produced in Examples 3, 5, 6 and 7 showed that the particles were in each case very pure and highly crystalline. This can be seen from FIG. 2 which is the x-ray diffraction pattern obtained on the powder products made by Example 5. This pattern is typical of the x-ray diffraction patterns of silver particles produced by the invention. Helium pycnometry measurement of the density of the particles from Examples 5 and 6 showed that the particles were fully densified as shown by the fact that their densities were substantially the same as theoretical (10.5 cc/g).

The above data show that the method of the invention provides a very desirable alternative to the prior art method of reduction of metal salt solutions for the production of high-quality silver particles suitable for electronic applications. Silver powders made by the aerosol decomposition method of the invention are pure, dense, unagglomerated, spherical and have a controlled size dependent on the aerosol generator and the concentration of the salt solution. Silver powders made by the invention do not have the impurities, irregular shape and agglomeration commonly found in silver particles produced by solution precipitation. Furthermore, fully reacted and densified silver particles were produced at temperatures significantly below the melting point of silver.

From experience with the method of the invention, it is believed that silver particles are formed in accordance with the following sequence when the reaction system is based on aqueous $AgNO_3$ and the carrier gas is $N_2$:

(1) As the aerosol is heated above the evaporation temperature of the solvent, the solvent is evaporated from the aerosol droplets thus forming porous particles of $AgNO_3$;

(2) As the porous $AgNO_3$ particles are heated further at 400–450 C., the $AgNO_3$ particles are decomposed to form porous silver particles; and (3) During the remainder of the residence time within the reactor furnace, the porous silver particles become fully densified.

We claim:

1. A method for the manufacture of finely divided, substantially fully dense, spherical silver particles comprising the sequential steps:

A. Forming an unsaturated solution of thermally decomposable silver-containing compound in a thermally volatilizable solvent;

B. Forming an aerosol consisting essentially of finely divided droplets of the solution from step A dispersed in an inert carrier gas, the droplet concentration being below the concentration where collisions and subsequent coalescence of the droplets would result in a 10% reduction in droplet concentration during the reaction residence time of the following step C;

C. Heating the aerosol to an operating temperature of at least 600° C., volatilizing the solvent, whereby the silver-containing compound is decomposed to form finely divided, spherical particles of pure silver, further heating to equal or greater than the densification temperature of the silver particle, but below the melting point of silver by which the silver particles are densified; and D . Separating the finely divided, substantially fully dense, spherical silver particles from the carrier gas, decomposition by-products and solvent volatilization products.

2. The method of claim 1 in which the carrier gas is $N_2$.

3. The method of claim 1 in which the carrier gas is air and the aerosol is heated to a temperature of at least 900 C.

4. The method of claim 1 in which the silver-containing compound is $AgNO_3$.

5. The method of claim 1 in which the thermally volatilizable solvent is deionized water.

* * * * *